US005294969A

United States Patent [19]

Ito

[11] Patent Number: 5,294,969

[45] Date of Patent: Mar. 15, 1994

[54] IMAGE FORMING APPARATUS HAVING A PLURALITY OF DEVELOPING DEVICES

[75] Inventor: Hideo Ito, Toyokawa, Japan

[73] Assignee: Minolta Camera Kabushiki Kaisha, Osaka, Japan

[21] Appl. No.: 946,535

[22] Filed: Sep. 17, 1992

[30] Foreign Application Priority Data

Sep. 18, 1991 [JP] Japan ..... 03-268435

[51] Int. Cl.[5] ..... G03G 15/01

[52] U.S. Cl. ..... 355/326 R; 355/208; 355/327

[58] Field of Search ..... 355/208, 204, 203, 245, 355/326, 327, 77

[56] References Cited

U.S. PATENT DOCUMENTS 4,894,684 1/1990 Nakajima et al. ..... 355/245 X
4,937,626 6/1990 Kohtani et al. ..... 355/245
4,958,191 9/1990 Yamada et al. ..... 355/245
4,970,557 11/1990 Masuda et al. ..... 355/208 X
5,014,095 5/1991 Yamada ..... 355/327
5,103,764 4/1992 Fujiwara et al. ..... 355/326 X
5,138,398 8/1992 Yamada ..... 355/326
5,182,584 1/1993 Fukunaga et al. ..... 355/245 X

*Primary Examiner*—A. T. Grimley
*Assistant Examiner*—Sandra L. Brasé
*Attorney, Agent, or Firm*—Burns, Doane, Swecker & Mathis

[57] ABSTRACT

Copying apparatus having a movable developing unit provided with a plurality of developing devices. This copying apparatus measures the mechanical characteristics of the drive mechanism driving the developing unit and determines if these characteristics deviate from normal values, and the drive signals transmitted to the drive mechanism are adjusted in accordance with the results of the measurement.

16 Claims, 16 Drawing Sheets

IMAGE FORMING APPARATUS HAVING A PLURALITY OF DEVELOPING DEVICES

BACKGROUND OF THE INVENTION

1. Field of the Invention

The present invention relates to an image forming apparatus having a plurality of developing devices, and more specifically relates to an image forming apparatus having movable developing devices.

2. Description of the Related Art

Image forming apparatus have been proposed provided with a developing unit having a plurality of developing devices wherein said developing unit is moved, then a specified developing device is stopped so as to be positioned at a predetermined developing position, and a developing operation is subsequently accomplished using said developing device.

In the image forming apparatus of the aforementioned type, the aforesaid developing unit must be moved at high speed and accurately stopped at a predetermined position because the time required to change the developing devices controls the copying speed.

Therefore, the image forming apparatus of the aforementioned type provides a control means for controlling the movement of a specified developing device to the developing position, and a unit driving means for moving and stopping the developing unit in accordance with movement control signals transmitted from said control means.

The mechanical characteristics of the aforesaid unit driving means (friction, resistance to moving the developing unit, and the like) are changed by changes in the weight of the developing unit due to consumption of the toner accommodated within the developing devices, environmental factors such as temperature and the like, or deterioration of a constant output spring used for balancing the device or the like. That is, deviations from the normal state may occur in the aforesaid mechanical characteristics. The normal state may be, for example, a state wherein a predetermined amount of toner is accommodated in each developing device, i.e., a state wherein the aforesaid spring or the like is set at a regulated value prior to shipping from the factory.

When deviations from the normal state occur as previously mentioned, accurately controlling the movement at high speed becomes difficult. A reason for the aforesaid difficulty is that the table data for regulating the movement control signals are set so as to be compatible with the normal state. Therefore, when the mechanical characteristics change and the deviations from the normal state occur, the actual moving speed of the developing unit is a value different from the speed achievable in the normal state and, accordingly, high speed and accurate movement control are difficult to achieve.

The aforementioned mechanical deviations are conventionally managed by methods such as:

(a) absorbing said deviations by using a large-capacity developing unit drive motor;

(b) mounting a regulating mechanism on the unit driving means which is periodically adjusted service personnel as needed.

However, the effectiveness of the aforesaid methods is inadequate and labor intensive.

SUMMARY OF THE INVENTION

An object of the present invention is to provide an image forming apparatus and method for accurately driving a developing unit.

In order to achieve the aforesaid object, the method of the present invention measures the movement or movement characteristics of the developing unit, and adjusts the developing unit drive signals in accordance with the results of said measurements.

In order to achieve the aforesaid object the apparatus of the present invention provides a measuring means for measuring the movement or movement characteristics of the developing unit, and an adjusting means for adjusting the developing unit drive signals in accordance with the results of said measurements.

The apparatus and method of the present invention adjusts the developing unit drive signals in accordance with the movement or movement characteristics of the developing unit, thereby producing excellent developing unit movement by compensating for changes in movement characteristics when such changes occur.

DESCRIPTION OF THE PREFERRED EMBODIMENTS

1 General construction of a copying apparatus

Figure 1:
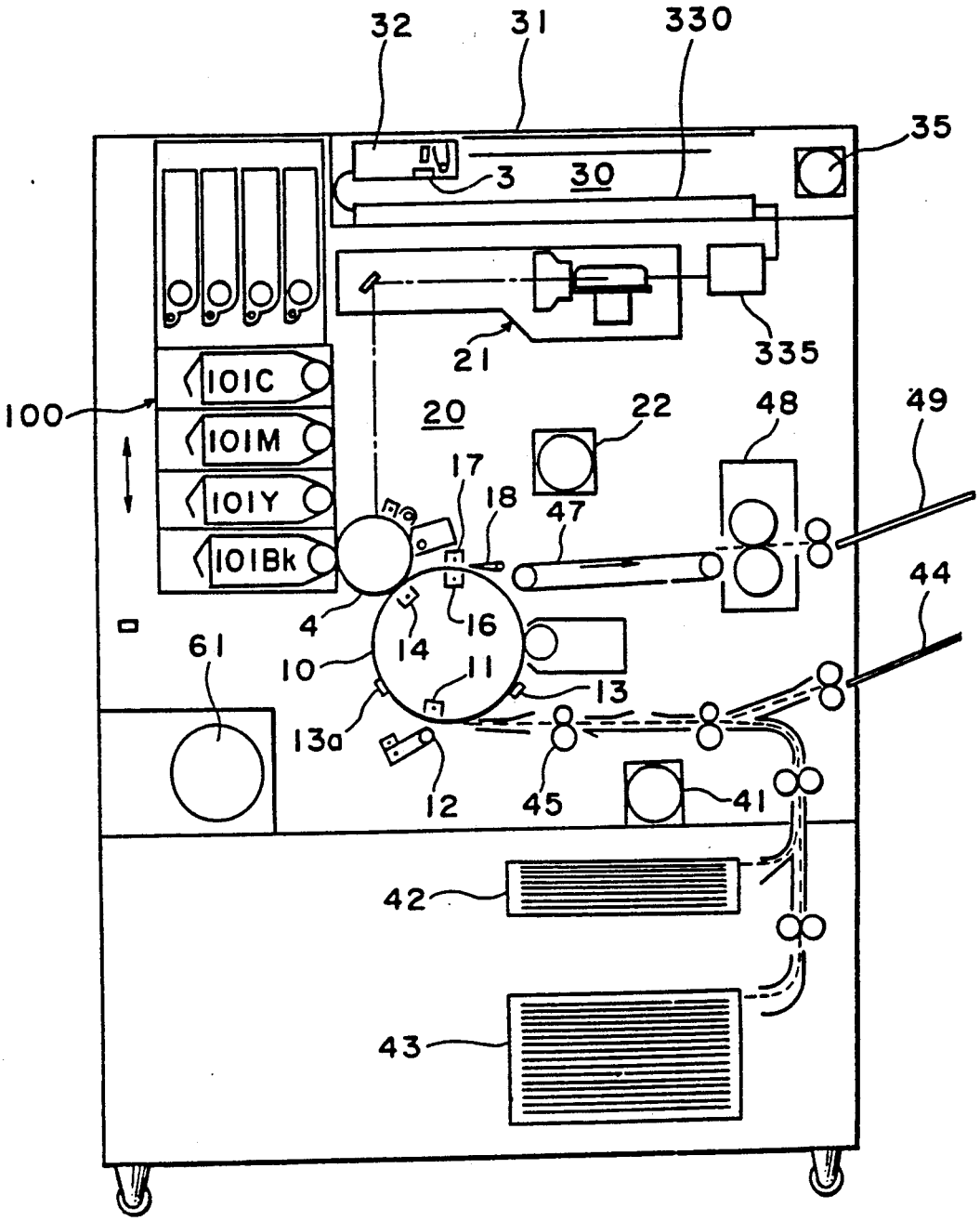
FIG. 1 is an illustration showing the general construction of a copying apparatus of the present embodiment.

FIG. 1 is an illustration showing the general construction of a copying apparatus of the present embodiment. This copying apparatus comprises a reading portion 30 and a printer portion 20.

1-1 Reading Portion 30

Image data generation through image scanning is accomplished in the reading portion 30.

The reading portion 30 scans the image surface of an original document placed on the document platen 31 by means of the scanner 32, and after the image sensor (CCD) 3 photoelectrically converts the reflected image light, the image signal processing portion 330 executes a predetermined process to produce digital image data which are stored in the buffer memory 335.

The scanner 32 is driven by a scanner motor 35 and moves downwardly along the document platen 31 during the scanning operation. The document image scan is performed by the scanner 32 a number of times in accordance with the set color mode.

The output of the laser device 21 of the printer portion 20 is controlled by the digital image data stored in the buffer memory 335, so as to form an electrostatic latent image on the surface of the photosensitive drum 4, as described hereinafter.

1-2 Printer Portion 20

The printer portion 20 comprises an image forming portion (laser device, photosensitive drum, and the like), developing unit, and paper processing portion (paper feeding and discharge systems, transfer drum and the like).

An electrostatic latent image is formed by the laser light in the image forming portion.

The laser light emitted from the laser device 21 scans the surface of the photosensitive drum 4 which is uniformed charged and rotating at constant speed, said scan being in the axial direction of said drum 4 (main scan direction, i.e., direction perpendicular to the paper surface in FIG. 1). Thus, an electrostatic latent image corresponding to the aforesaid digital image data is formed on the surface of the photosensitive drum 4.

The aforesaid electrostatic latent image is developed by toner from the developing unit, and said toner image is subsequently transferred to a paper sheet adhered to the surface of the photosensitive drum 4, as described hereinafter. The transfer drum 10 is driven by the drum drive motor 22 in conjunction with the photosensitive drum 4, such that said transfer drum 10 is rotated at the same circumferential speed, albeit in the opposite direction, as the photosensitive drum 4, The developing unit accomplishes toner development of the electrostatic latent image after a specified developing device is positioned at a predetermined developing position relative to the photosensitive drum 4. In FIG. 1, the block developing device 101Bk is disposed at the developing position.

The developing unit comprises a developing unit 100 which accommodates four developing devices (cyan developing device 101C for developing with cyan toner; magenta developing device 101M for developing with magenta toner; yellow developing device 101Y for developing with yellow toner; black developing device 101Bk for developing with black toner), and toner hoppers disposed above said developing unit 100 which accommodate toners of different colors corresponding to said respective developing devices.

The developing unit 100 is constructed so as to be movable in one direction and an opposite direction. The driving force to achieve the aforesaid movement is accomplished by an elevator motor 61. The moving mechanism is described later.

In the paper processing portion, the copy sheets are fed, wrapped around the transfer drum 10, the image is fixed, and the sheets are discharged and the like.

The paper sheet is fed from paper cassette 42 or cassette 43, or inserted from the manual feed portion 44, and advanced toward the transfer drum 10 via a group of rollers until said sheet is wrapped around the transfer drum 10.

Then, the toner image formed on the surface of the photosensitive drum 4 is transferred to the copy sheet.

The number of transfers is determined by the set color mode. For example, when the full-color mode is set, all four of the aforementioned developing devices are used for the developing process, such that the transfer operation is executed four times.

After the transfer process is completed, the sheet is peeled from the transfer drum 10, then the sheet is subjected to the image fixing process by the fixing device 48. Thereafter, the sheet is discharged to the discharge tray 49.

In the drawing, item 45 is a pair of timing rollers, item 47 is a transport belt, item 11 is a charger for electrostatically adhering the paper sheet to the transfer drum 10, item 12 is a sheet pressing roller, item 14 is a transfer charger for electrostatically attracting the toner on the surface of the photosensitive drum 4 to the paper sheet, items 16 and 17 are dischargers for separating the paper sheet by discharging the transfer drum 10 after the toner transfer is completed, item 18 is a separation member for peeling the paper sheet from the transfer drum 10, item 13 is a reference position sensor for detecting the reference position of the transfer drum 10, item 13*a* is a actuator plate for moving the reference position sensor 13. The aforesaid transport roller group, transport belt 47 and the like are driven by the main motor 41.

2 Details of Developing Unit 100

The developing unit 100 is described hereinafter with reference to FIGS. 2 and 3.

2-1 Position Detecting Mechanism

The developing unit 100 accommodates four developing devices which are movable in one direction and an opposite direction. A specified developing device is positioned at a developing position by means of the aforesaid movement in one direction and an opposite direction. In FIGS. 1 through 3, the black developing device 101Bk is shown disposed at the developing position.

The developing device disposed at the developing position is detected by the developing position sensors 103C, 103M, 103Y and 103Bk. That is, at the back side of the developing unit 100 (side which does not confront the photosensitive drum 4, viewed in the arrow A direction in FIG. 2), the four developing position sensors 103 (C, M, Y, Bk) are arranged and mounted to the main unit if the copying apparatus. Each of the sensors 103 (C, M, Y, Bk) are light sensors which optically detect objects. More specifically, each sensor contains a photoemitter element and a photoreceptor element disposed with a predetermined spacing therebetween so as to form an optical path. When an object is interposed so as to block the light between the photoemitter element and the photoreceptor element, the optical path is blocked and the object is thereby detected. At the back surface of the four developing devices 103 (C, M, Y, Bk), the optical paths of the developing position sensors 103C, 103M, 103Y and 103Bk are respectively provided with light shielding plates 102C, 102M, 102Y, and 102Bk disposed at the developing position.

Figure 2:
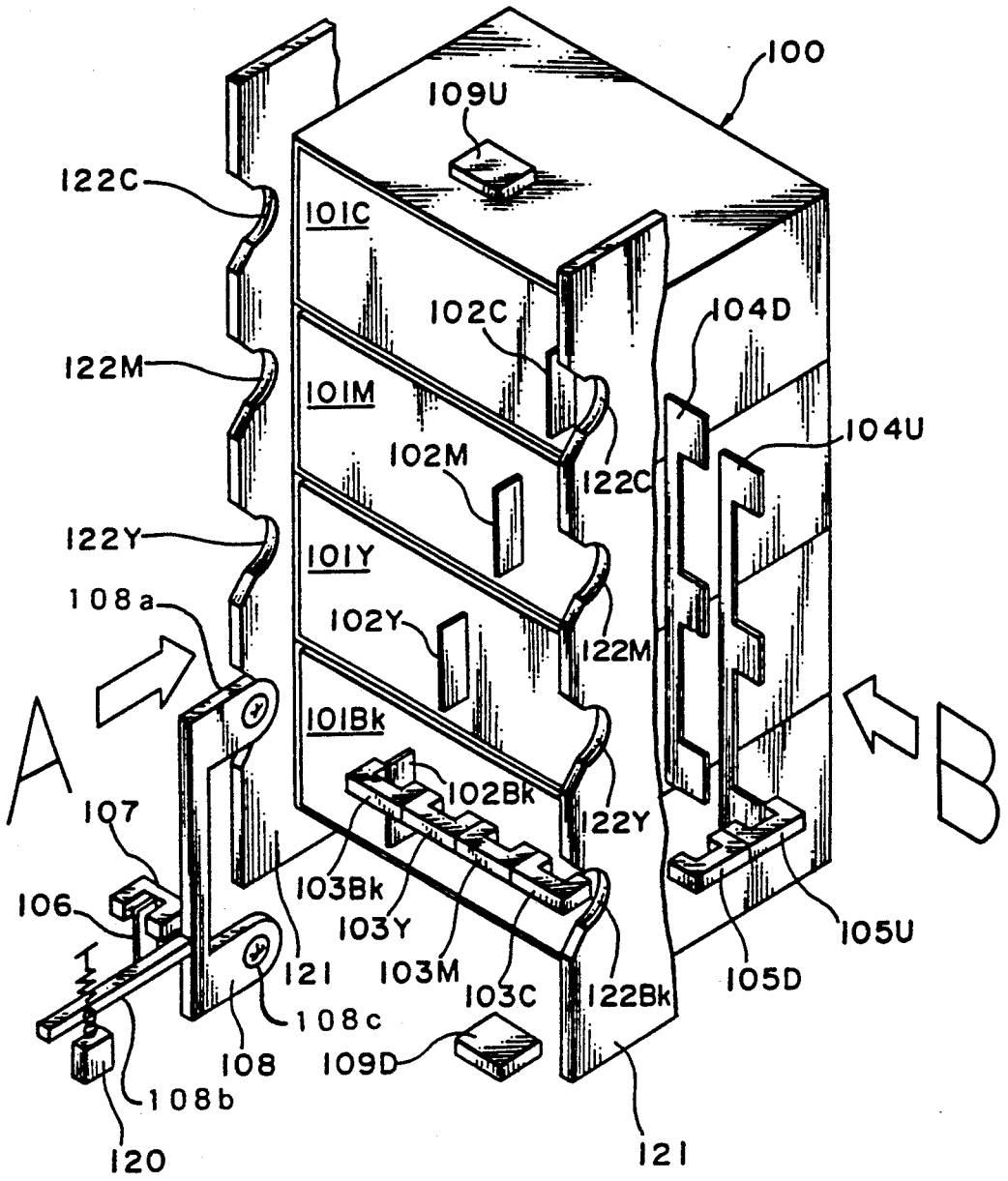
FIG. 2 is a perspective view briefly showing the developing unit installed in the copying apparatus of FIG. 1.
Figure 3B:
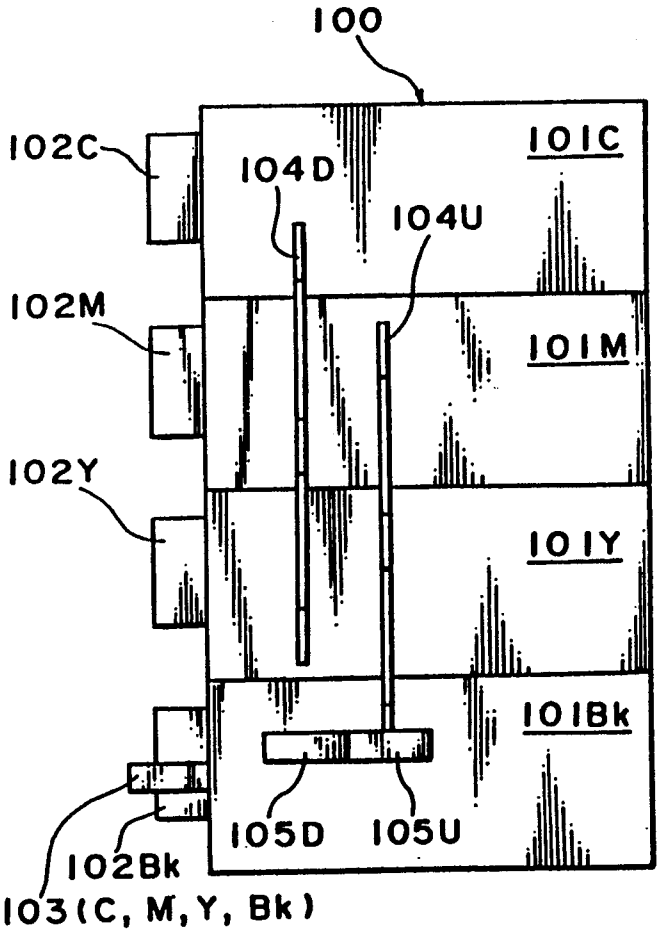
FIGS. 3A and 3B are an illustrations of the developing unit installed in the copying apparatus viewed from the A direction and B direction of FIG. 2.
Figure 3A:
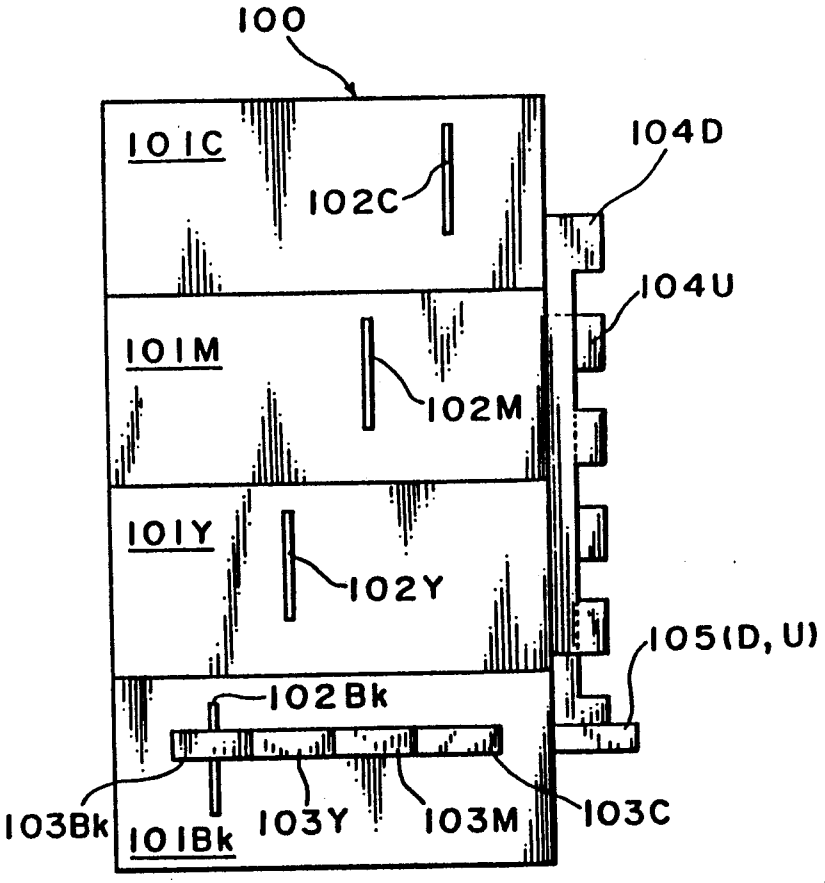

In FIG. 2, the shield plate 102Bk provided for the black developing device 101Bk blocks the optical path of the sensor 103Bk used to detect the black developing device. Thus, the presence of the black developing device 101Bk disposed at the developing position is detected.

In the drawing, item 109U is a sensor for detecting the upper limit of normal movement, and item 109D is a sensor for detecting the lower limit of normal movement.

The home position of the developing unit 100 is the position detected by the sensor 109U. When power is turned on, the developing unit 100 rises and stop at the position detected by the sensor 109U.

2-2 Control Period Detecting Device

The braking time (brake timing) during the movement of the developing unit 100 is detected by means of the mechanism described below.

An acceleration braking sensor 105U and a deceleration braking sensor 105D are respectively provided at heights corresponding to the developing position on the main unit of the copying apparatus opposite the side wall viewed from the B direction of the developing unit 100. The aforesaid sensors 105U and 105D are photosensors identical to the sensors 103 (C, M, Y, Bk).

In the aforesaid apparatus, at the moment the off edge output of the braking sensors 105 (U, D) is detected during the movement of the developing unit 100 via the final protruding portion of the of the aforementioned shield plates 104 (U, D), the braking signal is turned on, to effect braking of the movement of said developing unit 100. The aforesaid off edge output describes the change of sensor output from the on state to the off state. The off edge output is the sensor output immediately following the passage of the aforesaid protruding portion of the shield past the sensor.

2-3 Locking Device

The developing unit 100 is locked at the developing position by means of the device described below. A locking plates 121 are fixedly attached to the back surface of both the aforesaid side walls (viewed from the A direction in FIG. 2) of the developing unit 100 so as to be integratedly joined to said side walls. The locking plates 121 are members which receive the protruding portions **108*a* formed at the front end of the locking member 108, and notched portions 122C, 122M, 122Y and 122Bk** are respectively formed at each developing position corresponding to each developing device (C, M, Y, Bk).

When the movement of the developing unit 100 is completed, the unit is locked by the insertion of the aforementioned protruding portions **108*a* into the corresponding notched portions 122 (C, M, Y, Bk). A force is applied in the upward direction to the back end 108*b* of the locking member 108 via a spring 120*a*. That is, the insertion (locking) of the protruding portion 108*a* is realized by means of the force applied by the aforesaid spring 120*a* with the front end 108*c* at the bottom of the locking member 10** being the pivot.

The retraction (lock release) of the protruding portion **108*a* from the notched portion 122 (C, M, Y, Bk) is accomplished by a lock release solenoid 120 provided at the reverse position (downward) of the spring 120*a*. That is, when the lock release solenoid 120 is turned on, the back end 108*b* at the bottom of the locking member 108 is pulled such that the protruding portion 108*a* is retracted from the notched portion 122** (C, M, Y, Bk), thereby releasing the lock.

The locked state and the lock released state are detected by means of a lock sensor 107 fixedly attached to the main unit of the copying apparatus. The sensor 107 is a photosensor identical to the sensors 103 (C, M, Y, Bk). When locked, the shield plate 106 mounted on the locking member 108 is inserted in the lock sensor 107, thereby blocking the sensors photocircuit and switching on the sensor. When the lock is released, the blocked light is unblocked and the lock sensor is turned off.

3 Control Circuit Construction

Figure 4:
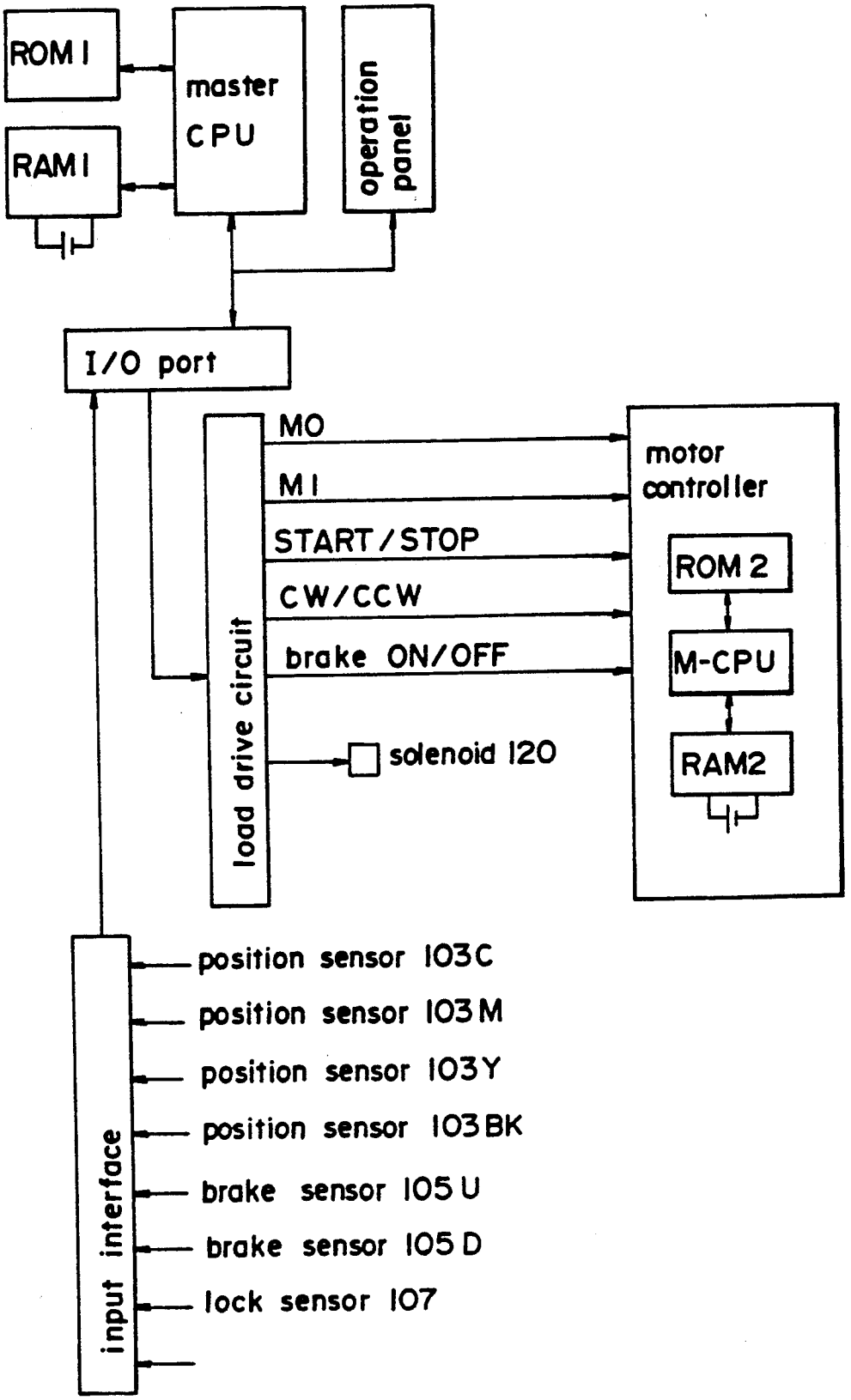
FIG. 4 is a block diagram showing the construction of a part of the control circuit of the copying apparatus.
Figure 5:
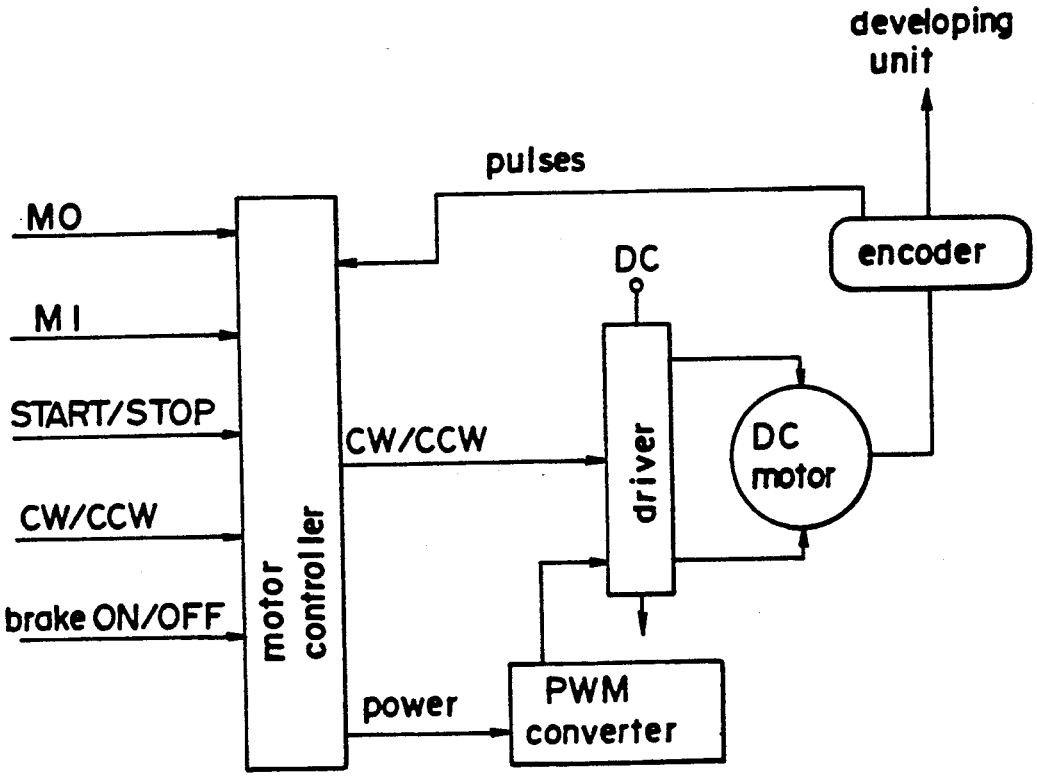
FIG. 5 is a block diagram showing the construction of the remaining portion of the control circuit of the copying apparatus.

The construction of the circuit for controlling the movement and stopping of the developing unit 100 is described hereinafter with reference to FIGS. 4 and 5. The control circuit has a master central processing unit (CPU) and a motor controller (controller for elevator motor 61) which controls the vertical movement of the developing unit 100 in accordance with control signals (described later) transmitted from said master CPU.

a read only memory (ROM) 1 containing the control programs and a random access memory (RAM) 1 for operations are connected to the aforesaid master CPU. The master CPU is also connected to the operation panel.

The master CPU outputs drive signals for the developing unit 100 to accomplish the image forming process in accordance with the mode input from the operation panel. For example, when the single-color mode is set, the developing device 101 required to reproduce the specified color is moved to the developing position. Furthermore, when the full-color mode is set, the four developing devices are moved to the developing position in a predetermined sequence.

Signals are input to the master CPU from the various sensors (developing positions sensors 103 (C, M, Y, Bk), braking sensors 105 (U, D), lock sensors 107 and the like) via the input/output (I/O) ports and input interface. Control signals are output from the master CPU to the aforementioned motor controller via the I/O ports and load drive circuit. Furthermore, signals for turning on and off the lock release solenoid 120 are also output from the master CPU.

The aforesaid control signals output from the master CPU to the motor controller are described below.

M0, M1: speed control signals output to the elevator motor 61;

START/STOP: rotation and stop control signals output to the elevator motor 61;

CW/CCW: forward rotation and reverse rotation control signals output to the elevator motor 61;

Brake ON/OFF: brake on and brake off control signals.

The aforesaid M1, M0 control signals are set in accordance with distance of the movement required.

For example, when the developing unit 100 is to be moved a distance of one unit, the control signals are such that (M1, M0)=(0, 1). In this case, the elevator motor 61 is rotated at low speed, as indicated by the solid line in FIG. 18, so as to move the developing unit 100 at low speed.

Figure 18:
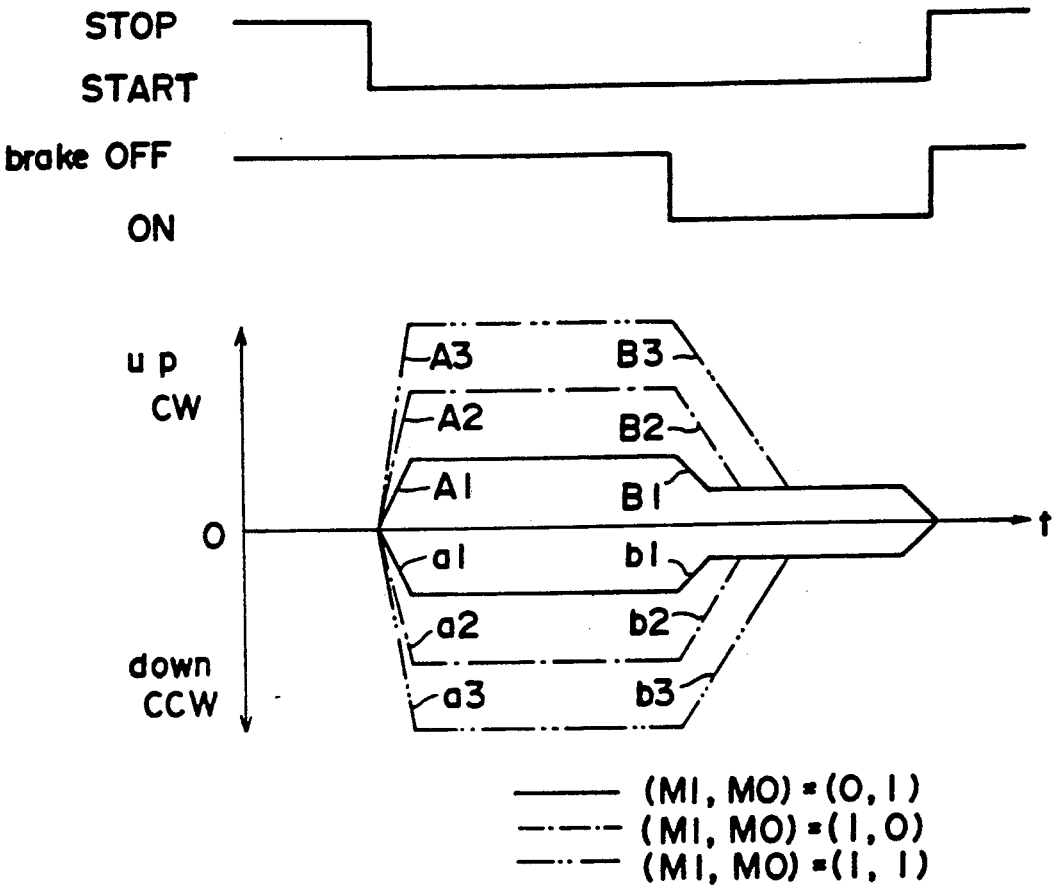
FIG. 18 is an illustration showing the relationship between the control signals M1, M0 and the speed.

When the developing unit 100 is to be moved a distance of two units, the control signals are such that (M1, M0)=(1, 0), and the motor 61 rotates at intermediate speed, as indicated by the single dashed line in FIG. 18.

Similarly, when the movement distance is three units, the control signals are such that (M1, M0)=(1, 1), and the motor 61 rotates at high speed, as indicated by the double dashed line in FIG. 18.

The movement distance of a single unit moves a developing device adjacent to the developing position to said developing position. For example, in FIGS. 1 through 3, the yellow developing device 101Y is moved a distance of a single unit to the developing position.

The aforesaid STOP/START control signals indicate "ON" with low level and "OFF" with high level, as shown in FIG. 18.

The aforesaid CW/CCW control signals indicate "elevate" with CW and "lower" with CCW, as shown in FIG. 18.

The aforesaid brake ON/OFF control signals indicate "ON" with low level and "OFF" with high level, as shown in FIG. 18.

The motor controller receives the various aforesaid control signals contained in the motor controller CPU (M-CPU) and ROM2 and RAM2, and controls the actuation of the elevator motor 61 via a driver.

The aforesaid speed control signals and the like are converted to output signals by the motor controller, are converted to pulse width signals by the PWM converter, and are input to the driver. The aforesaid forward rotation and reverse rotation signals are also input to the driver to switch polarity and control braking. The elevator motor 61 is provided with an encoder that detects the rotational speed of said motor 61 and inputs said data to the motor controller.

In the following description, the electrical signals output from the motor controller are expressed as PM during acceleration control, and as BM during braking control.

4 Motor Controller Processing

The processing by which the motor controller controls the movement of the developing unit 100 is described hereinafter with reference to the flow charts of FIGS. 6 through 17.

Figure 6:
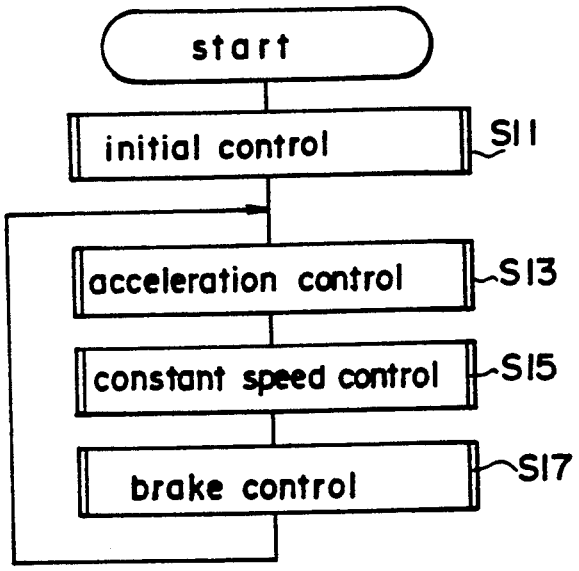
FIG. 6 is a flow chart showing the main routine and interrupt routine of the motor control process of FIG. 5.
Figure 6:
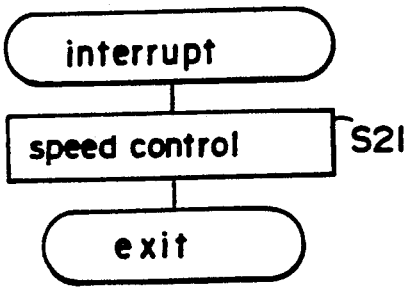
Figure 7:
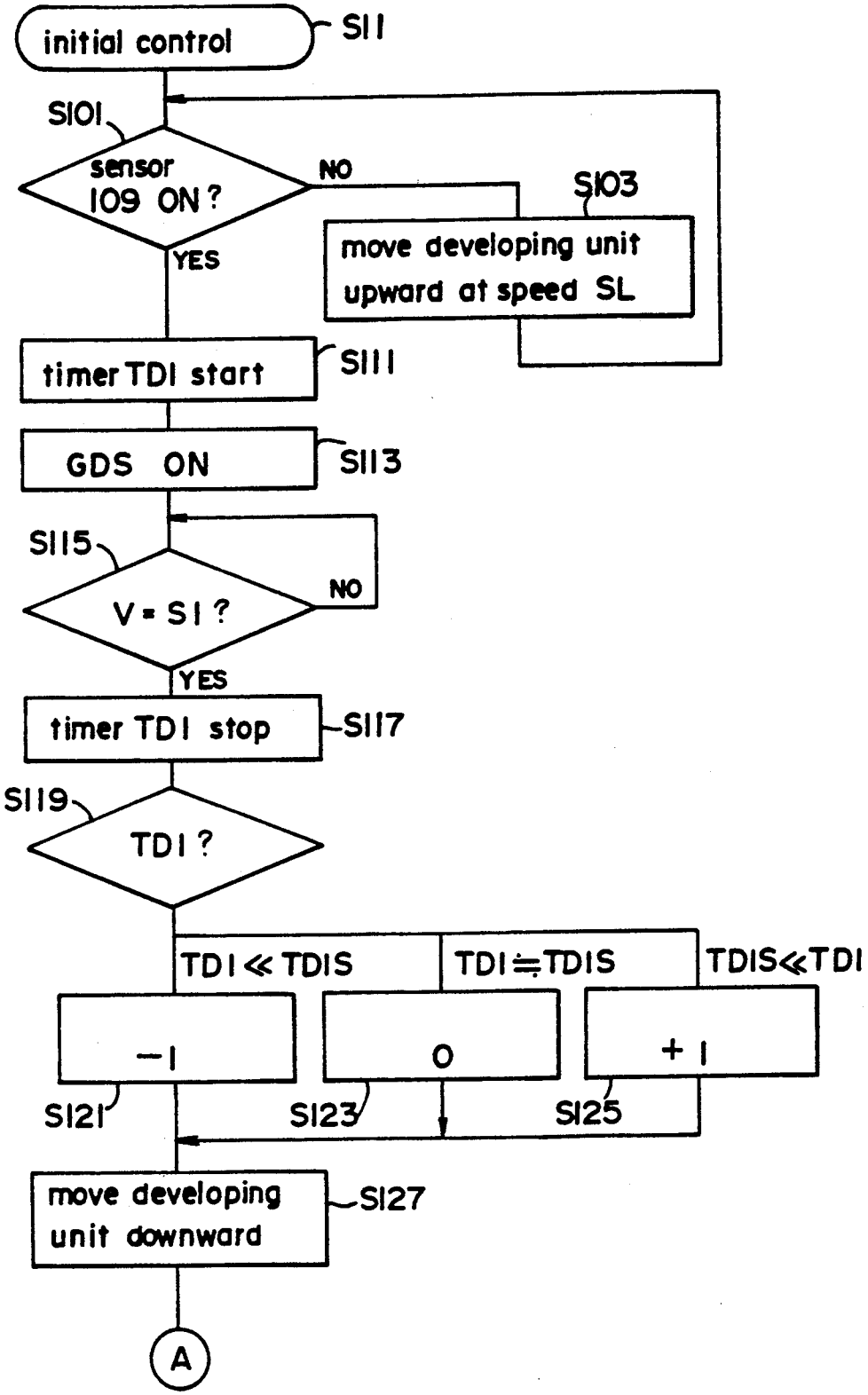
FIG. 7 is a flow chart showing a part of the initial control process of FIG. 6.
Figure 8:
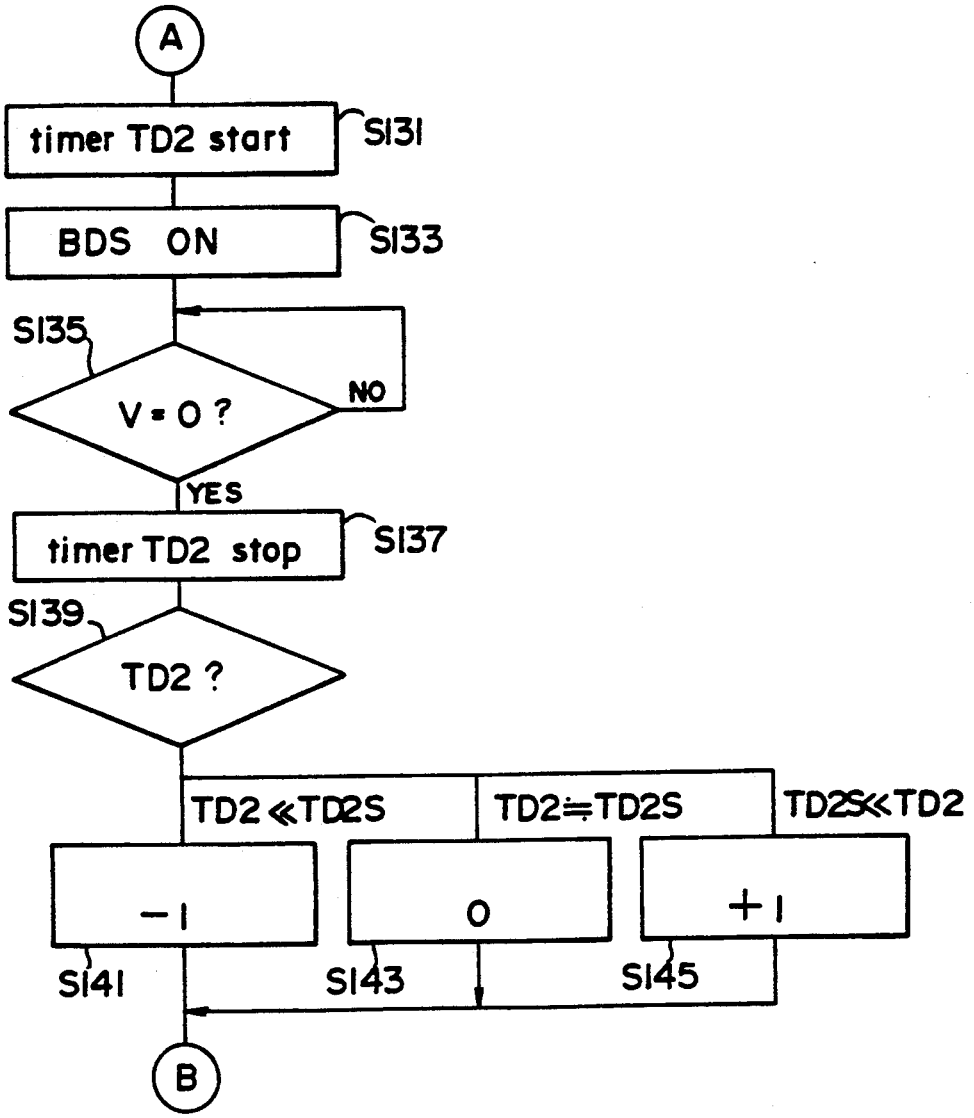
FIG. 8 is a flow chart showing a part of the initial control process of FIG. 6.
Figure 9:
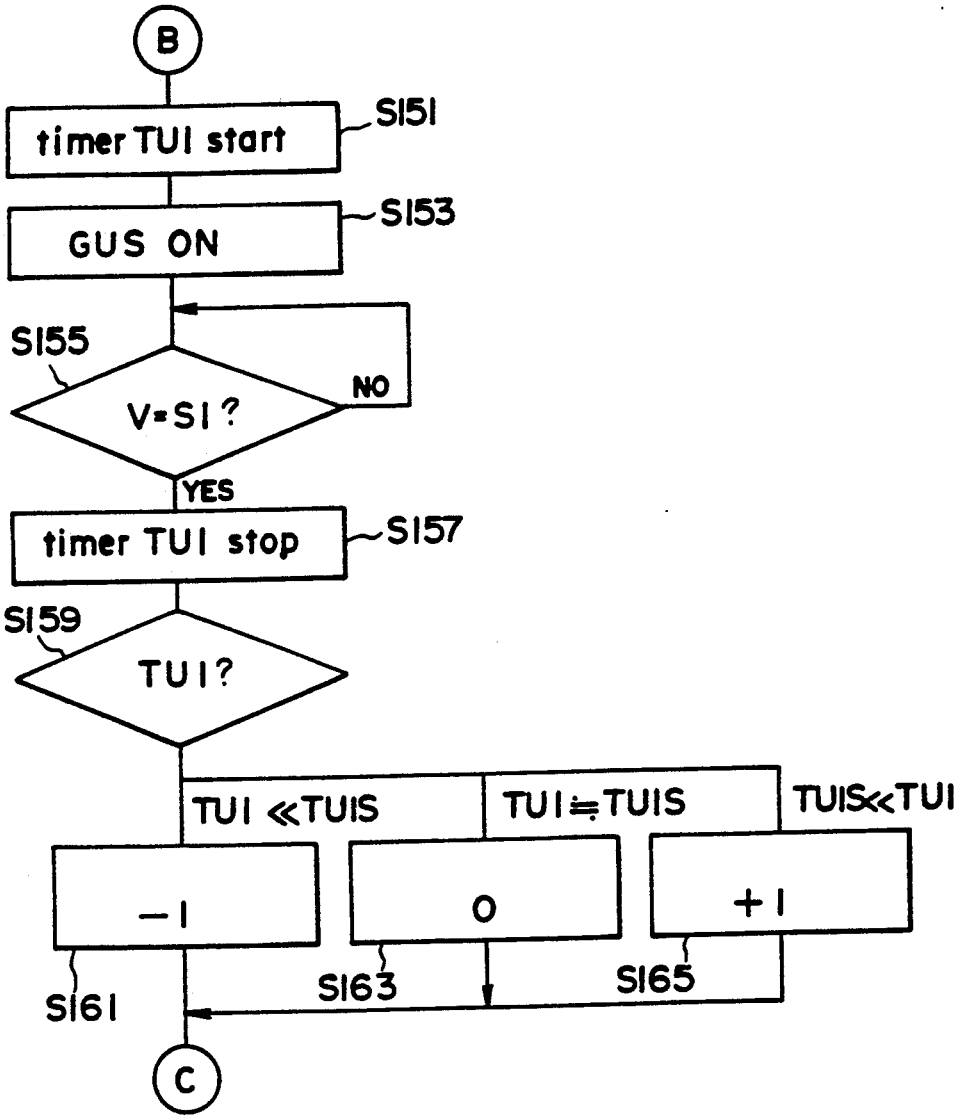
FIG. 9 is a flow chart showing a part of the initial control process of FIG. 6.
Figure 10:
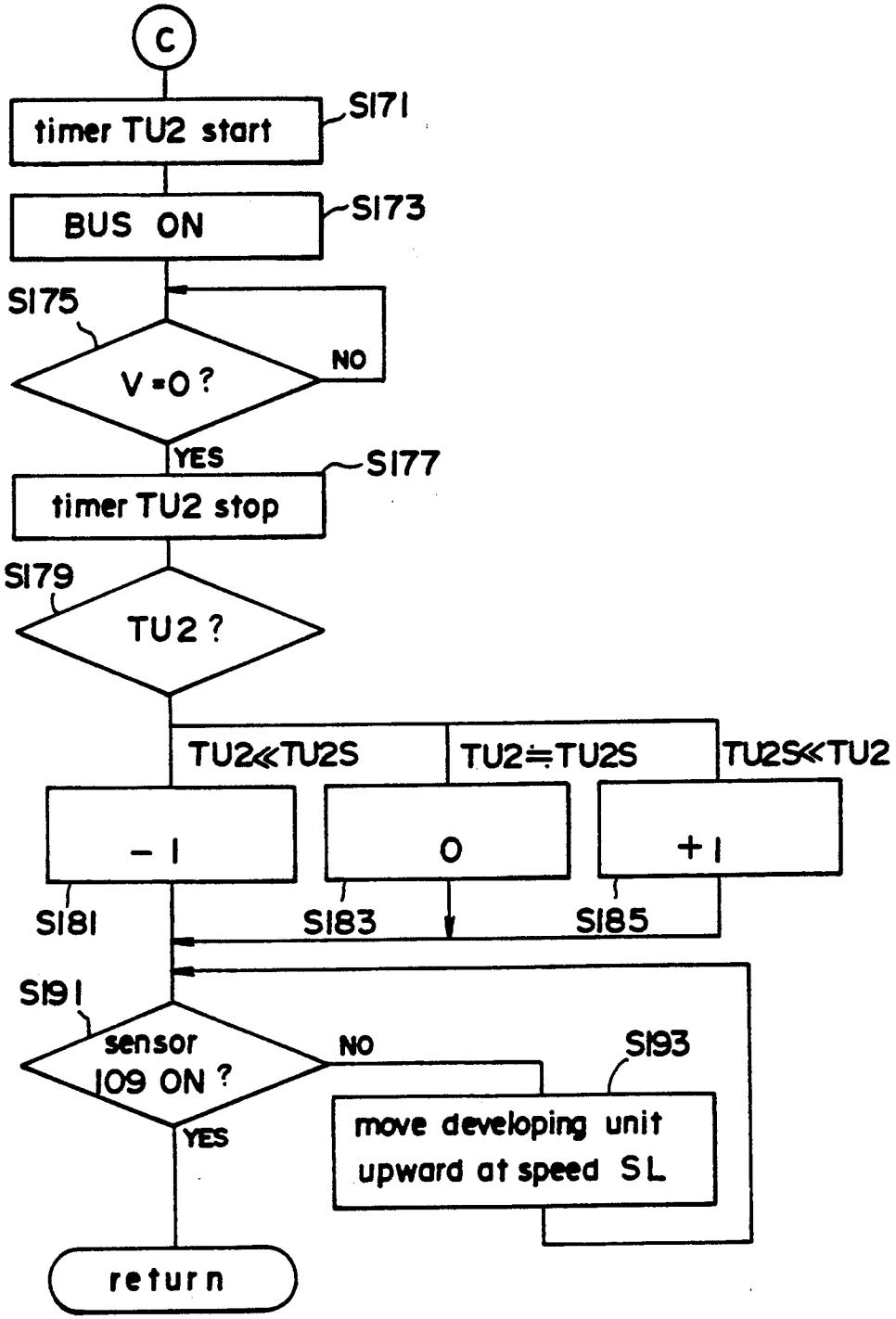
FIG. 10 is a flow chart showing the remaining portion of the initial control process of FIG. 11 is a flow chart showing the acceleration control process of FIG. 6.
Figure 11:
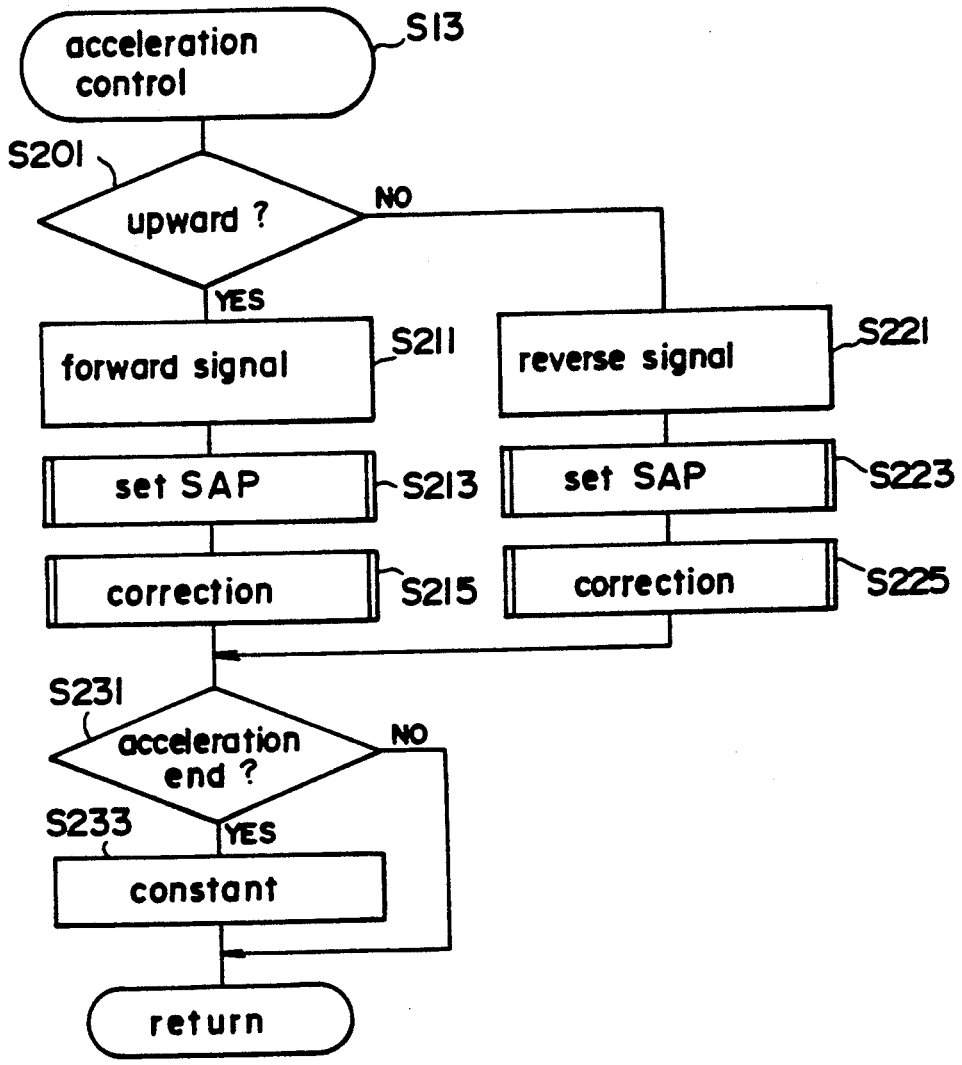

4-1 Main Routine (FIG. 6)

When the power is first turned on, the initial control process is executed by the motor controller (step S11). The initial control process (test driver) is a process for setting the correction coefficient relative to a power signal and in accordance with the deviation of the mechanical characteristics from the normal state of the drive mechanism of the developing unit 100. The aforesaid process (step S11), is executed prior to an actual image forming operation, i.e., before the operation to form an original document image on the surface of the photosensitive drum.

After the initial control process is completed, the motor controller continues to the acceleration control process (step S13), constant speed control process (step S15), and braking control process (step S17) executed in accordance with signal transmitted from the master CPU. The aforesaid process (steps S13, S15, S17) are executed during an actual image forming operation, i.e., during the operation for forming an original document image on the surface of the photosensitive drum. The signals transmitted from the master CPU are fetched by the interrupt process so as to

4-2 Initial Control Process (FIGS. 7~10)

After the developing unit 100 returns to the home position (steps S101~S103), the power correction coefficient during down acceleration (steps S111~S125), the power correction coefficient during down braking (steps S131~S145), the power correction coefficient during up acceleration (steps S151~S165), and the power correction coefficient during up braking (steps S171~S185) are sequentially set. Thereafter, the developing unit 100 again returns to the home positions (steps S191~S193).

Return to Home Position (steps S101~S103)

When the developing unit 100 is not at the home position, the M-CPU outputs a return signal to the PWM to raise the developing unit at a speed SL. Thus, the developing unit 100 is returned to the home position.

Down Acceleration (steps S111~S125)

The count of the timer TD1 and the down acceleration of the constant acceleration GDS are started (steps S111, S113). The down acceleration of the constant acceleration GDS is herein defined as the output of a first standard power signal (test signal) for realizing the constant acceleration GDS when the mechanical characteristics of the drive mechanism is in the normal state.

Then, when the speed reaches a predetermined value S1 (step S115; YES), the count of the timer TD1 is stopped and the timer value is determined (steps S117, S119).

When the result of the aforesaid determination is such that (TD1<TD1S), i.e., when the mechanical characteristics of the drive mechanism are such that a predetermined speed S1 is achieved much faster than the time period TD1S required for the normal state, the down acceleration correction coefficient is set at [−1] (step S121). That is, the power signal during movement control is reduced, such that the down acceleration is corrected and reduced.

Conversely, when the result of the aforesaid determination is such that (TD1S<TD1), i.e., when the mechanical characteristics of the drive mechanism are such that a predetermined speed S1 is achieved much more slowly than the time period TD1S required for the normal state, the down acceleration correction coefficient is set at [+1] (step S125). That is, the power signal during movement control is increased, such that the down acceleration is corrected and increased.

When the result of the aforesaid determination is such that (TD1≈TD1S), correction is unnecessary and, therefore, the down acceleration correction coefficient is set at [0] (step S123).

After some or all of the processes of the aforementioned steps S121 through S125 are executed, the developing unit 100 continues the distance [a] downward movement at a constant speed S1 (step S127).

Down Braking (steps S131~S145)

The processes during down breaking are substantially similar to processes during the aforesaid down acceleration. That is, the count of the timer TD2 and the down braking of the constant braking BDS are started (steps S131, S133). The aforesaid start of the down braking of the constant braking BDS is herein defined as starting output of a second standard power signal (test signal) to realize a constant braking BDS when the mechanical characteristics of the drive mechanism is in the normal state.

When the movement of the developing unit 100 stops (step S135; YES), the count of the timer TD is stopped and the value of said timer is determined (steps S137, S139).

When the results of the aforesaid determination are such that (TD2<TD2S), i.e., when the mechanical characteristics of the drive mechanism are such that stopping the developing unit is much faster than the time period D2S required for the normal state, the down braking correction coefficient is set at [−1] (step S141). That is, the power signal during braking control is reduced, such that the down braking is corrected and reduced.

Conversely, when the result of the aforesaid determination is such that (TD2S<TD2), i.e., when the mechanical characteristics of the drive mechanism are such that stopping the developing unit is much more slowly than the time period D2S required for the normal state, the down braking correction coefficient is set at [+1] (step S145). That is, the power signal during movement control is increased, such that the down braking is corrected and increased.

When the result of the aforesaid determination is such that (TD2≈TD2S), correction is unnecessary and, therefore, the down braking correction coefficient is set at [0] (step S143).

Up Acceleration (steps S151~S165) and Up Braking (steps S171~S185)

The processes at these times are identical to the aforementioned processes of down acceleration (steps S111~S125) and down braking (steps S131~S145). Therefore, the descriptions of these processes are omitted here.

The signals output from the motor controller, e.g., the return signal for returning the developing unit to the home position, the first reference signal for down acceleration, and the second reference signal for down braking, are respectively stored in the ROM2. Similarly, the third reference signal for up acceleration and fourth reference signal for up braking are also stored in the ROM2. Furthermore, the down acceleration correction coefficient, down braking correction coefficient, up acceleration correction coefficient and up braking correction coefficient obtained via the aforesaid controls are respectively stored in the RAM2.

4-3 Acceleration Control Process (FIGS. 11~14)

The acceleration control during upward movement and downward movement of the developing unit 100 is accomplished by fetching the acceleration correction coefficient set during the previously described initial control process.

When a command is issued from the master CPU to the motor controller to raise the developing unit 100 (step S201; YES), the forward/reverse rotation signal is set at forward (step S211), then the standard acceleration power SAP is set (step S213), and the correction I is executed in step S215.

When a command is issued from the master CPU to the motor controller to lower the developing unit 100 (step S201; NO), the forward/reverse rotation signal is set at reverse (step S211), then the standard acceleration power SAP is set (step S223), and the correction II is executed in step S225.

Furthermore, when the acceleration is completed (step S231; YES), the constant speed control is executed (step S233).

The previously mentioned standard acceleration power setting processes (steps S213, S223) set the standard acceleration power signals SAP in accordance with the control signals [M1, M0] transmitted from the master CPU.

Figure 12:
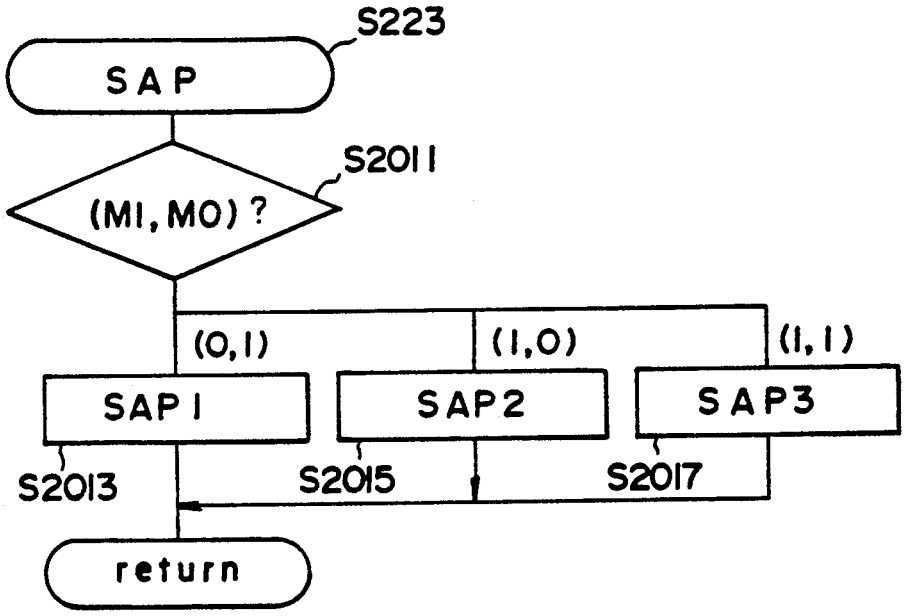
FIG. 12 is a flow chart showing the standard acceleration power setting process of FIG. 13 is a flow chart showing the correction I process of FIG. 11.
Figure 13:
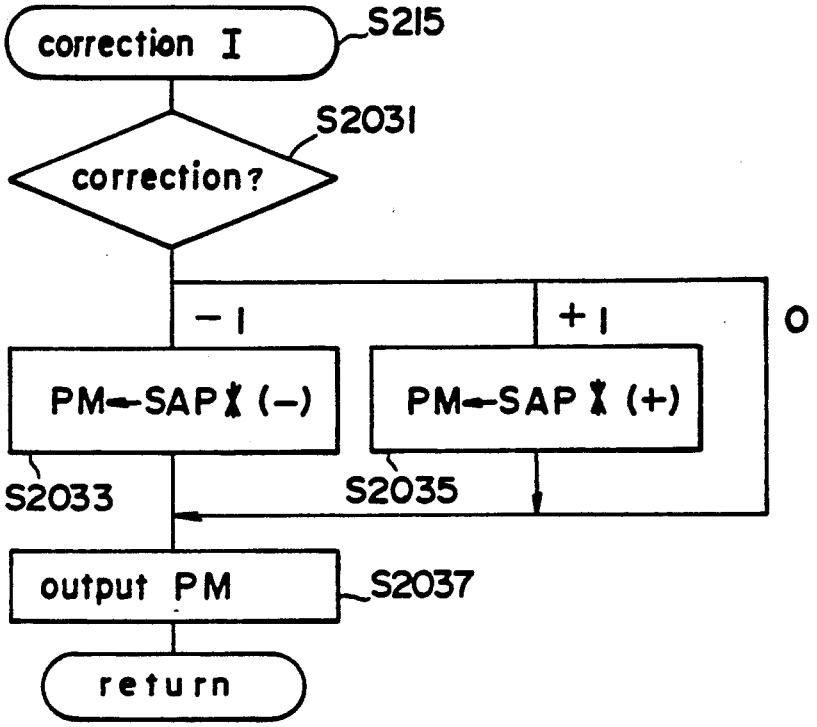
Figure 14:
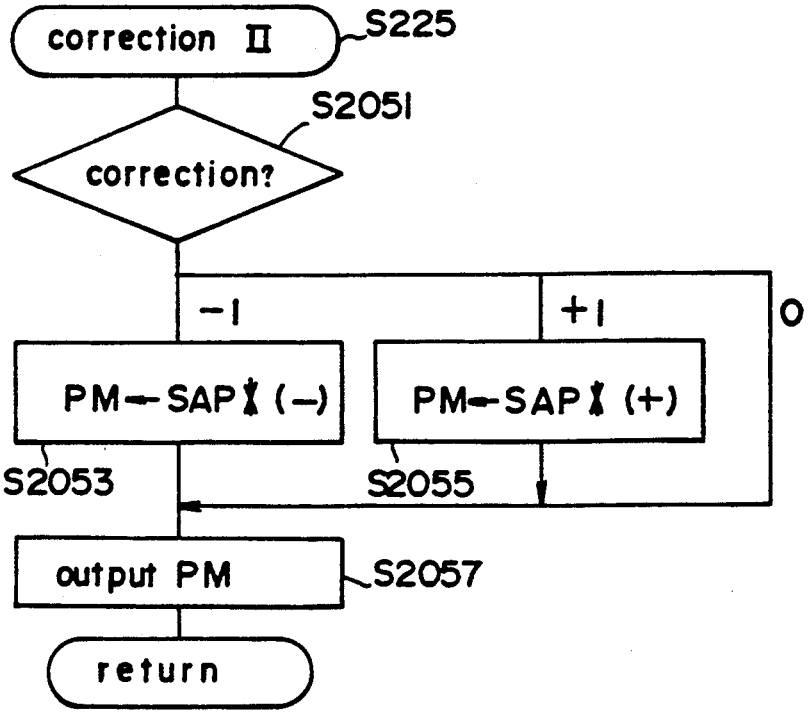
FIG. 14 is a flow chart showing the correction II process of FIG. 11.

The standard acceleration power signals SAP are described hereinafter with reference to FIGS. 12 and 18.

When the control signals (M1, M0) are (0, 1), the motor controller outputs the signal SAP1 (step S2013). This signal SAP1 causes the developing unit to move at the low speed A1 or a1, indicated by the solid line in FIG. 18, when the moving characteristics of the developing unit drive mechanism are ideal.

When the control signals (M1, M0) are (1, 0), the motor controller outputs the signal SAP2 (step S2015). This signal SAP2 causes the developing unit to move at the acceleration A2 or a2, indicated by the single dashed line in FIG. 18, when the moving characteristics of the developing unit drive mechanism are ideal.

When the control signals (M1, M0) are (1, 1), the motor controller outputs the signal SAP3 (step S2017). This signal SAP2 causes the developing unit to move at the high speed A3 or a3, indicated by the double dashed line in FIG. 18, when the moving characteristics of the developing unit drive mechanism are ideal.

Furthermore, the values of the signals SAP1, SAP2, and SAP3 are stored in the ROM2, and are respectively read from the ROM2 in accordance with the control signals transmitted from the master CPU.

The previously described up acceleration power correction process (correction I) (step S215) corrects the power signal SAP set by the SAP process (step S213) by means of the correction coefficient set in the initial control process, and following said correction outputs the signal as the power signal PM.

For example, if the up acceleration correction coefficient set by the initial control process is [−1] (step S2031), the power signal SAP is corrected by said [−1] (step S2033), and following said correction the signal is transmitted as the power signal PM to the PWM converter (step S2037).

Similarly, if the up acceleration correction coefficient set by the initial control process is [+1] (step S2031), the power signal SAP is corrected by said [+1] (step S2035), and following said correction the signal is transmitted as the power signal PM to the PWM converter (step S2037).

The previously mentioned acceleration power correction process (correction II) (step S225) is identical to the up acceleration power correction process (correction I) described above. That is, the power signal SAP set by the SAP process (step S223) is corrected as necessary by means of the correction coefficient set in the initial control process (steps S2053, S2055), and following said correction the signal is output as the power signal PM to the PWM converter (step A2057).

Figure 15:
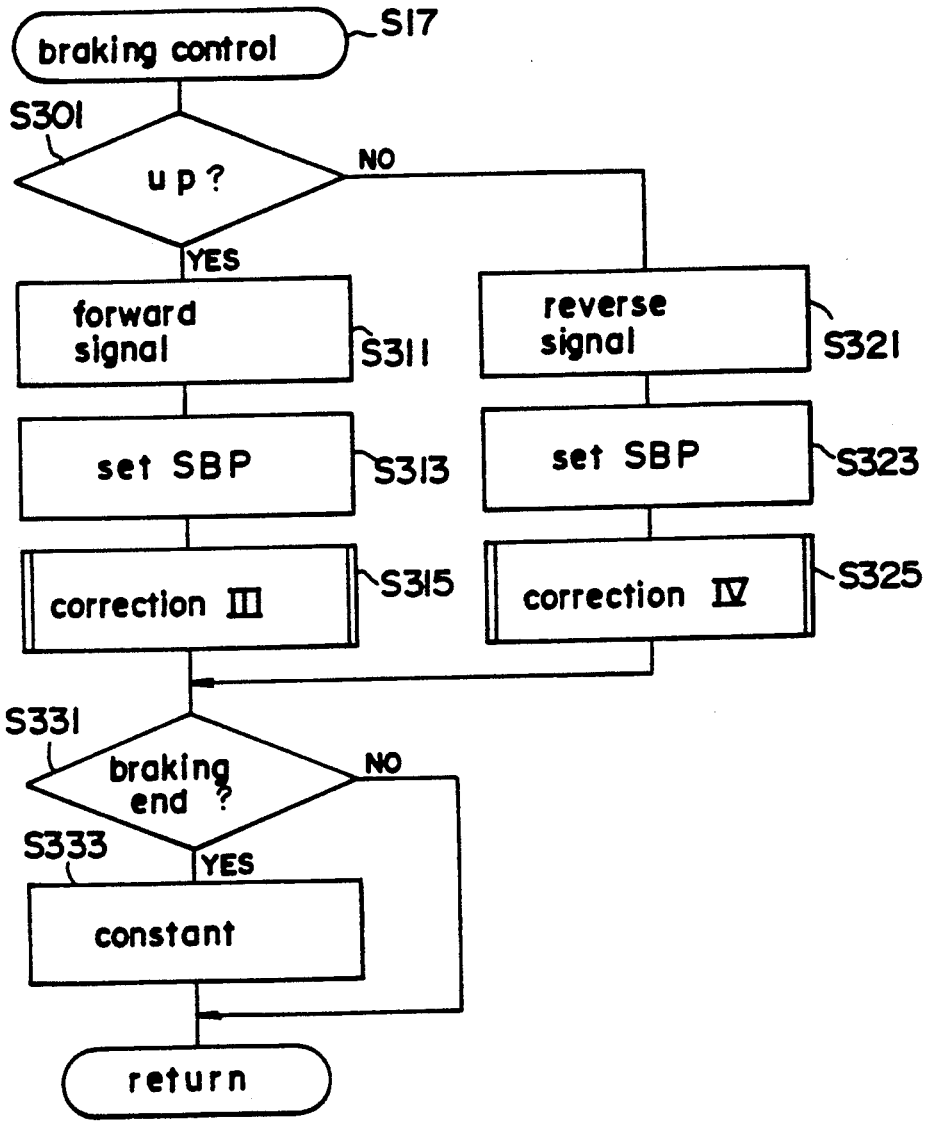
FIG. 15 is a flow chart showing the braking control process of FIG. 6.
Figure 16:
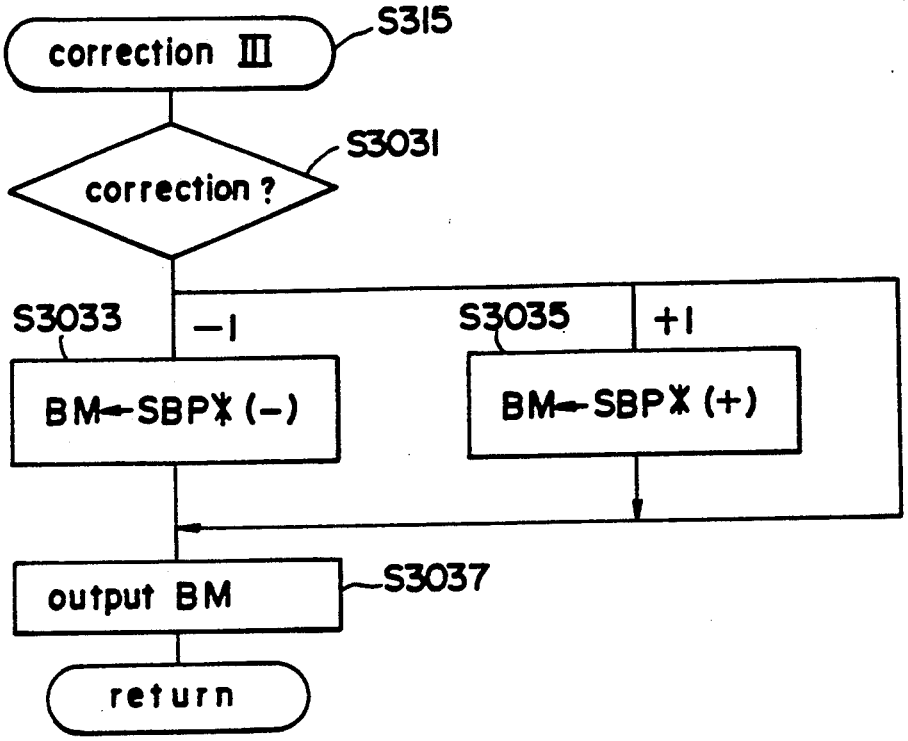
FIG. 16 is a flow chart showing the correction III process of FIG. 15.
Figure 17:
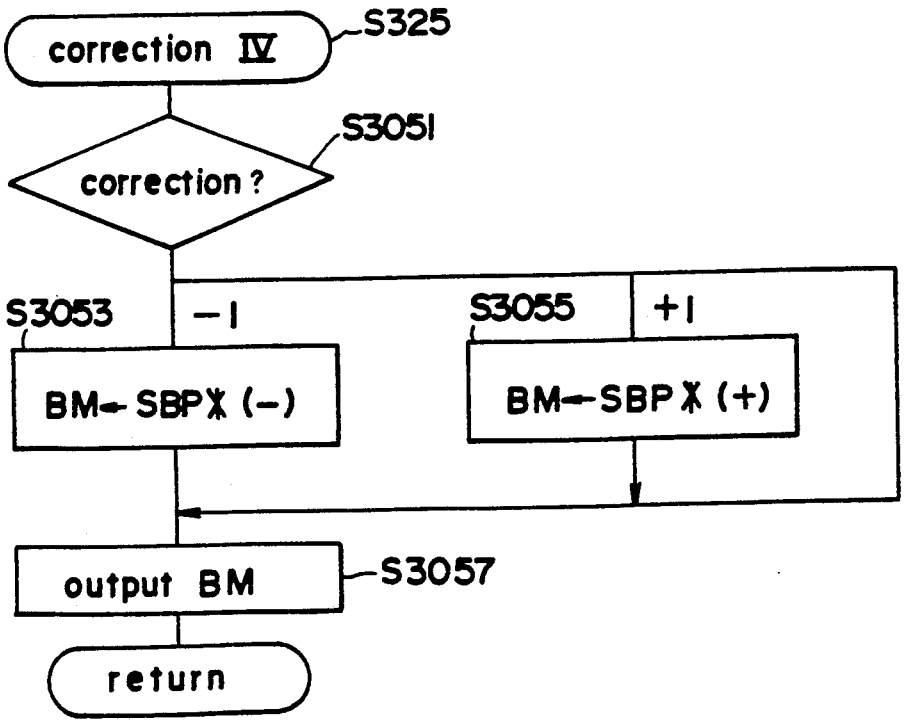
FIG. 17 is a flow chart showing the correction IV process of FIG. 15.

4-4 Brake control Process (FIGS. 15~17)

The brake control during upward movement and downward movement of the developing unit 100 are executed by means of the braking correction coefficient set in the initial control process.

If the developing unit 100 is currently ascending (step S301; YES), the forward/reverse rotation signal is set to reverse (step S311), and thereafter the standard brake power SBP is set (step S313) and the up brake power is corrected (step S315). On the other hand, if the developing unit is currently descending (step S301; NO), the forward/reverse rotation signal is set to forward (step S321), and thereafter the standard brake power SBP is set (step S323) and the down brake power is corrected (step S325).

Furthermore, when the aforesaid controls are completed (step S331; YES), the constant speed control is executed (step S333).

The previously described standard brake power setting process (steps S313, S323) sets the standard deceleration power signal SBP in accordance with the control signals (M1, M0) transmitted from the master CPU.

The standard deceleration power signal SBP is described hereinafter with reference to FIG. 18.

When the control signals (M1, M0) are (0, 1), the motor controller outputs a standard deceleration power signal SBP1. This signal SBP1 causes the developing unit to decelerate at the low deceleration speed B1 or b1, indicated by the solid line in FIG. 18, when the moving characteristics of the developing unit drive mechanism are ideal.

When the control signals (M1, M0) are (1, 0), the motor controller outputs a standard deceleration power signal SBP2. This signal SBP2 causes the developing unit to decelerate at the intermediate deceleration speed B2 or b2, indicated by the single dashed line in FIG. 18, when the moving characteristics of the developing unit drive mechanism are ideal.

When the control signals (M1, M0) are (1, 1), the motor controller outputs a standard deceleration power signal SBP3. This signal SBP3 causes the developing unit to decelerate at the high deceleration speed B3 or b3, indicated by the double dashed line in FIG. 18, when the moving characteristics of the developing unit drive mechanism are ideal.

Furthermore, the values of the signals SBP1, SBP2, and SBP3 are stored in the ROM2, and are respectively read from the ROM2 in accordance with the control signals transmitted from the master CPU.

The up braking power correction process (correction III) (step S315) corrects the power signal SBP set by the standard braking power setting process (step S313) via the correction coefficient set in the initial control process, and following said correction outputs said signal as the power signal BM.

For example, if the up braking correction coefficient set by the initial control process is [−1] (step S3031), the power signal SBP is corrected by said [−1] (step S3033), and following said correction the signal is transmitted as the power signal BM to the PWM converter (step S3037).

Similarly, if the up braking correction coefficient set by the initial control process is [+1] (step S3031), the power signal SBP is corrected by said [+1] (step S3035), and following said correction the signal is transmitted as the power signal BM to the PWM converter (step S3037).

The previously mentioned down braking power correction process (correction IV) (step S325) is identical to the up braking power correction process (correction III) described above. That is, the power signal SBP set by the SBP process (step S323) is corrected as necessary by means of the correction coefficient set in the initial control process (steps S3053, S3055), and following said correction the signal is output as the power signal BM to the PWM converter (step A3057).

Figure 19:
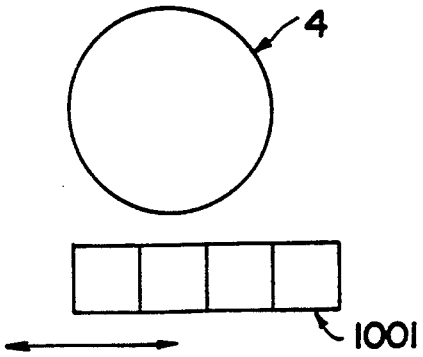
FIG. 19 is an illustration showing an example of the developing unit moving in a transverse direction.

Although the aforesaid embodiment has been described in terms of the developing unit 100 moving vertically in one direction and an opposite direction, it is to be noted that the present invention is also applicable to movement of the developing device 100 in lateral directions, as shown in FIG. 19.

Furthermore, while the aforesaid embodiment has been described in terms of the up acceleration correction coefficient, down acceleration correction coefficient, up braking correction coefficient and down braking correction coefficient being [−1], [0], and [+1], it is to be understood that the present invention may be constructed so as to use multiple levels of said correction coefficients so as to be continuously changeable.

Although the up and down braking corrections are executed via correction of the power signal PM in the aforesaid embodiment, the present invention may also accomplish said correction by correction the braking time.

While the test drive of the developing devices for determining the correction coefficient is accomplished when the power is first turned on in the aforesaid embodiment, the present invention is not limited to such an arrangement. For example, the test drive may alternatively be accomplished after a predetermined number of copies have been made. Furthermore, a special switch may be provided to specify a test, drive such that said test drive may be accomplished in response to said special switch.

Although the present invention has been described with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. In an image forming apparatus comprising a movable developing unit on which a plurality of developing devices are mounted, a motor which drives the developing unit, and a driving circuit which controls an operation of the motor in accordance with a driving signal, a method of adjusting the driving signal comprising the steps of:

feeding a predetermined driving signal to the driving circuit;

driving the motor in accordance with the predetermined signal to position a designated one of the developing devices at a developing position;

measuring a movement of the developing unit driven by the motor and generating an adjusting coefficient based on a result of the measurement; and adjusting the driving signal by use of the adjusting coefficient.

2. The method as claimed in claim 1, further comprising the step of:

storing the adjusting coefficient data in a memory.

3. The method as claimed in claim 2, further comprising the steps of:

feeding said predetermined driving signal when a power switch of the image forming apparatus is turned on; and storing said adjusting coefficient in the memory before the image forming apparatus starts an actual image forming operation.

4. The method as claimed in claim 3, further comprising the step of:

feeding the driving signal adjusted by said adjusting coefficient to the driving circuit during the actual image forming operation.

5. In an image forming apparatus comprising a movable developing unit on which a plurality of developing devices are mounted, a method comprising the steps of:

feeding a predetermined driving signal to a driving motor which drives the developing unit to position a designated one of the developing devices at a developing position;

driving the motor in accordance with the predetermined signal;

measuring an actual movement of the developing unit driven by the motor; and adjusting the driving signal in accordance with a result of said measurement.

6. The method as claimed in claim 5, further comprising the steps of:

feeding said predetermined driving signal when a power switch of the image forming apparatus is turned on; and adjusting said driving signal before the image forming apparatus starts an actual image forming operation.

7. The method as claimed in claim 6, further comprising the step of:

feeding the adjusted driving signal to the driving motor during the actual image forming operation.

8. An image forming apparatus comprising:

a developing unit on which a plurality of developing devices are mounted;

supporting means for movably supporting the developing unit;

driving means, responsive to a driving signal, for driving said supporting means so as to position a designated one of the developing devices at a developing position;

signal feeding means for feeding the driving signal to the driving means;

measuring means for measuring the actual movement of the developing unit driven in response to the driving signal; and adjusting means for adjusting the driving signal based on a result of the measurement by the measuring means.

9. The image forming apparatus as claimed in claim 8, wherein said measuring means includes:

detecting means for detecting the movement of the developing unit;

comparing means for comparing a result of the detection with predetermined data; and generating means for generating an adjusting coefficient based on a result of the comparison.

10. The image forming apparatus as claimed in claim 9, further comprising means for storing the adjusting coefficient.

11. The image forming apparatus as claimed in claim 10, wherein:

said signal feeding means feed said predetermined driving signal when a power switch of the image forming apparatus is turned on; and said generating means generates the adjusting coefficient before the image forming apparatus starts an actual image forming operation.

12. An image forming apparatus comprising: photosensitive member;

image forming means for forming an electrostatic image on the photosensitive member;

developing unit on which a plurality of developing devices are mounted, each of said developing devices including different toners in color;

designating means for designating one of developing devices which is used for developing the electrostatic image on the photosensitive member;

driving mechanism which supports the developing unit movable along a predetermined path and drives the developing unit so as to position the designated developing unit at a developing position where the designated developing device faces the photosensitive member, said driving mechanism including a drive motor which propels the developing unit in response to a driving signal;

measuring means for measuring a driving characteristic of said driving mechanism; and adjusting means for adjusting the driving signal based on a result of the measurement by the measuring means.

13. The image forming apparatus as claimed in claim 12, wherein said measuring means feeds a test driving signal to the driving mechanism in order to operate the driving mechanism for a test purpose and measure the driving characteristics of the driving mechanism during the test drive of the driving mechanism.

14. The image forming apparatus as claimed in claim 13, wherein:

said measuring means compares the driving characteristics of the driving mechanism with standard data and obtains deviation data; and said adjusting means adjusts the driving signal based on the deviation data.

15. The image forming apparatus as claimed in claim 14, further comprising:

memory means for storing the deviation

16. The image forming apparatus as claimed in claim 13, wherein said measuring means feeds the test signal when a power switch of the image forming apparatus is turned on.

* * * * *